US008896512B2

(12) United States Patent
Zebedee

(10) Patent No.: US 8,896,512 B2
(45) Date of Patent: Nov. 25, 2014

(54) DISPLAY DEVICE FOR ACTIVE STORAGE PIXEL INVERSION AND METHOD OF DRIVING THE SAME

(75) Inventor: Patrick Zebedee, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 233 days.

(21) Appl. No.: 13/198,345

(22) Filed: Aug. 4, 2011

(65) Prior Publication Data

US 2013/0033479 A1 Feb. 7, 2013

(51) Int. Cl.
*G09G 3/36* (2006.01)

(52) U.S. Cl.
CPC ..... *G09G 3/3648* (2013.01); *G06G 2300/0814* (2013.01); *G09G 2300/0819* (2013.01); *G09G 2300/0823* (2013.01); *G09G 2300/0842* (2013.01); *G09G 2310/0251* (2013.01)
USPC ..... 345/96; 345/209

(58) Field of Classification Search
USPC ..... 345/211–213, 94–96
See application file for complete search history.

(56) References Cited

U.S. PATENT DOCUMENTS

| | | | | |
|---|---|---|---|---|
| 5,296,847 | A | 3/1994 | Takeda | |
| 6,064,362 | A | 5/2000 | Brownlow | |
| 6,897,843 | B2 | 5/2005 | Ayres | |
| 6,940,483 | B2 | 9/2005 | Maeda | |
| 7,573,451 | B2 | 8/2009 | Tobita | |
| 2003/0174116 | A1* | 9/2003 | Maeda et al. | 345/98 |
| 2007/0182689 | A1 | 8/2007 | Miyazawa | |
| 2009/0002582 | A1 | 1/2009 | Sano | |
| 2011/0090196 | A1* | 4/2011 | Li et al. | 345/209 |
| 2012/0038604 | A1* | 2/2012 | Liu et al. | 345/211 |
| 2012/0154262 | A1* | 6/2012 | Yamauchi | 345/100 |
| 2012/0154365 | A1* | 6/2012 | Yamauchi | 345/211 |

FOREIGN PATENT DOCUMENTS

| | | | |
|---|---|---|---|
| JP | 5-142573 | | 11/1991 |
| WO | WO 2011/027599 | * | 3/2011 |

OTHER PUBLICATIONS

Y. Asaoka et al., "Polarizer-free Reflective LCD Combined with Ultra Low-power Driving Technology", SID 09 Digest, pp. 395-398 (cited on p. 3, line 12 of the specification).

Y. Asaoka et al., "Polarizer-free Reflective LCD Combined with Ultra Low-power Driving Technology", SID 09 Digest, pp. 395-398 (cited on p. 3, line 12 of the specification; previously listed on IDS submitted on Aug. 4, 2011 with application).

Y. Asaoka et al., "Polarizer-free Reflective LCD Combined with Ultra Low-power Driving Technology", Informational Document, LCD Products, Oct. 2010.

* cited by examiner

*Primary Examiner* — Long D Pham
(74) *Attorney, Agent, or Firm* — Renner, Otto, Boisselle & Sklar, LLP.

(57) ABSTRACT

A pixel circuit for a display includes a pixel storage node for storing and presenting a pixel voltage to a pixel display element, a cell storage node for storing the data on the pixel storage node, and a first storage capacitor and a second storage capacitor each including a first electrode and a second electrode. The first electrode of the first storage capacitor is operatively coupled to the pixel storage node and the first electrode of the second storage capacitor operatively coupled to the cell storage node. The second electrode of the first and second storage capacitors is operatively coupled to a respective different one of first and second independent voltage signal lines. The pixel circuit further includes a pixel write circuit configured to write the pixel voltage to the pixel storage node during a data write cycle, and to provide respective voltage signals to the first and second independent voltage signal lines, each of the respective voltage signals being changed during the data write cycle in order to increase or reduce the pixel voltage.

23 Claims, 5 Drawing Sheets

Figure 1: Conventional Art

DISPLAY DEVICE FOR ACTIVE STORAGE PIXEL INVERSION AND METHOD OF DRIVING THE SAME

TECHNICAL FIELD

The invention relates to an active-matrix display device, and more particularly, to an active-matrix display device with very low update rate, wherein pixels of the display device include a means for holding data for an extended period. Further, the invention relates to a method of driving such a display device.

BACKGROUND ART

A typical active matrix liquid crystal display (LCD) includes an array of pixels such as the one shown in FIG. 1. Each pixel includes two transistors 8 and 10, a storage capacitor 16 and a liquid crystal (LC) cell 14. To write a data voltage to the pixel, the GL input is raised to a high state and a data voltage is driven on the SL input. The data voltage passes into the pixel via transistors 8 and 10, and is subsequently held on the pixel storage node 12 when the GL input is set to a low state. The voltage held on the pixel storage node is referred to as the pixel voltage, and controls the state of the LC cell and therefore the brightness of the pixel.

Such pixels, however, are not perfect: the transistors 8 and 10 exhibit a leakage current when in the off state. This leakage current results in a degradation of the pixel voltage over time. To address this problem, the display data is rewritten to the pixel to minimise image deterioration during the hold time. A frame refresh rate of 60 Hz is typical. This constant refreshing of the display results in significant power consumption, in particular because the column electrodes connecting the data to the SL input of each pixel must be repeatedly charged. One approach to reducing this power consumption is to reduce the frame refresh rate. Frame rate reduction is only possible if the degradation of the pixel electrode voltage is reduced. The pixel voltage degradation can be reduced by either increasing the size of the storage capacitor or reducing the leakage current. A larger storage capacitor is not desirable since it would result in increased pixel area and would increase the time taken to charge the pixel during data writing. Thus, the preferred approach to reducing the frame refresh rate is to reduce the leakage current.

Japanese laid-open patent application No. 5-142573 (Sato, Nov. 22, 1991) and U.S. Pat. No. 6,064,362 (Brownlow, May 16, 2000) and U.S. Pat No. 7,573,451 (Tobita, Aug. 11, 2009) disclose different implementations of a technique to reduce the deterioration of the pixel voltage. This technique involves "boot strapping": a unity gain voltage gain amplifier has its input connected to the pixel storage node 12 and its output connected to the junction between transistors 8 and 10, causing the pixel electrode voltage to appear at the junction of the series connected transistors 8 and 10. If the buffer amplifier were ideal and drew no charge from the pixel storage node 12, leakage from the pixel storage node 12 would be eliminated since the drain to source voltage of transistor 10 would be reduced to zero volts.

In the case of an LCD, the polarity of the voltage across the liquid crystal 14 must be inverted periodically. This prevents degradation of the LC material. In a 60 Hz display, the data driver typically inverts the voltage for each pixel each time it is written. Inversion may be implemented either by keeping the common electrode voltage, VCOM, constant and changing the voltage written to the pixel storage node (known as dc VCOM drive), or by changing the voltage applied to VCOM and changing the voltage written to the pixel storage node by a smaller amount (ac VCOM drive). In either case, the potential difference between the pixel storage node and VCOM should be the same absolute value but opposite polarity on alternate inversion cycles.

It is desirable to perform inversion of the LC voltage inside the pixels. To invert the data from the driver requires the column electrodes to be charged as well as the pixel capacitance. This consumes more power than in-pixel inversion, so it is undesirable in a battery-powered system.

None of the preceding prior art discloses a means for inverting the stored data inside the pixels. Instead, the data driver must write new, inverted data at an appropriate rate to prevent LC degradation.

U.S. Pat. No. 6,897,843 (Ayres, May 24, 2005) and US patent applications 2009/0002582A1 (Sano, Jan. 1, 2009) and 2007/0182689A1 (Miyazawa, Aug. 9, 2007) disclose pixel circuits that can perform inversion of the stored data without new data being written from the driver circuit. The inversion operation also serves to refresh the pixel voltage. Neither circuit includes any means for preventing degradation of the pixel voltage between inversion operations. The inversion frequency is therefore set by the pixel leakage current, and cannot be reduced to reduce the power consumed by the pixels.

"Polarizer-free Reflective LCD Combined with Ultra Low-power Driving Technology", Y. Asaoka et al., SID 09 Digest pp 395-8 (conference held May 31-Jun. 5, 2009), and U.S. Pat. No. 6,940,483 (Maeda, Sep. 6, 2005) both describe pixel circuits with separate memory and inversion parts. The memory part is formed from SRAM (static random access memory), a well-known type of electronic memory that does not suffer from leakage. As in US patent application 2007/0182689A1 (Miyazawa, Aug. 9, 2007), the LC voltage is inverted without inverting the stored data. An advantage of this circuit is that the stored data is held indefinitely without leakage, so the inversion rate can be reduced as far as the LC material will allow, reducing power consumption. However, an SRAM cell is formed from a relatively large number of transistors, which occupy a relatively large layout area. This restricts the maximum display resolution that can be achieved with this approach.

A further method of driving an LCD, common capacitor drive, is described in U.S. Pat. No. 5,296,847 (Takeda, Mar. 22, 1994). In this method, a voltage is written to the pixel storage node as in a conventional pixel. VCOM is held at a constant level. Once the GL input has been set to a low state, isolating the pixel storage node, the voltage applied to the VCS input is either raised or lowered. This has the effect of raising or lowering the voltage on the pixel storage node. The range of voltages written to the pixel and the level of voltage change on the VCS input are chosen such that the final voltage across the LC takes a value between the black and white voltages. By raising VCS on one refresh and lowering it on the next, the voltage across the LC is inverted on alternate cycles, as in the other VCOM drive schemes. Using this scheme, a display may be driven using dc VCOM, which has lower electrical noise than ac VCOM, while still using a narrow range of column and pixel voltages, which allow for lower power operation.

SUMMARY OF INVENTION

The prior art describes three types of pixel circuits: those with circuits to reduce leakage, such that new data may be written at a reduced rate; those which invert the data in the pixel, such that data need only be written when the displayed image is required to change; and those which store the data in SRAM and use the stored data to control the connection of external reference voltages, whereby the reference voltages alternate to implement inversion of the LC voltage.

Each of these approaches has disadvantages: pixel circuits which only reduce leakage must receive new, inverted data from the driver circuits at a rate dictated by the characteristics of the LC, therefore requiring relatively frequent charging of the column electrodes and increasing the power consumption of the display; pixel circuits which only invert the data in the pixel must perform the inversion at a relatively high frequency, such that the previous data has not been significantly degraded by leakage, also resulting in increased power consumption; SRAM pixels are large, and cannot be used in high resolution displays.

A device and method in accordance with the present invention provide a display utilising a pixel circuit that both minimises leakage of charge from the pixel and inverts the pixel data voltage internally. Such a display can be operated with the lowest possible power consumption, since the LC inversion rate may be reduced as far as the LC material will allow, the LC inversion may be performed without charging the column electrodes, and the driver circuits may be deactivated while the image is static. The device and method in accordance with the present invention enable the above functions using a minimum number of circuit elements. Additionally, the device and method in accordance with the invention function in a way that is compatible with common capacitor drive schemes.

According to a basic aspect of the invention, there is provided a display utilising a pixel circuit incorporating circuit elements for minimising the leakage of charge from the pixel, and additionally incorporating circuit elements for inverting the pixel voltage.

According to another aspect of the invention, there is provided a method of driving a display featuring such a pixel.

According to another aspect of the invention, the pixel includes two storage capacitors driven by signals which switch with different phase.

According to one aspect of the invention, a pixel circuit for a display includes: a pixel storage node for storing and presenting a pixel voltage to a pixel display element; a cell storage node for storing the data on the pixel storage node; a first storage capacitor and a second storage capacitor each including a first electrode and a second electrode, the first electrode of the first storage capacitor operatively coupled to the pixel storage node and the first electrode of the second storage capacitor operatively coupled to the cell storage node, and the second electrode of the first and second storage capacitors operatively coupled to a respective different one of first and second independent voltage signal lines; and a pixel write circuit configured to write the pixel voltage to the pixel storage node during a data write cycle, and to provide respective voltage signal to the first and second independent voltage signal lines, each of the respective voltage signals being changed during the data write cycle in order to increase or reduce the pixel voltage.

According to one aspect of the invention, the circuit includes a hold circuit operatively coupled to the pixel write circuit and configured to minimize leakage of charge from the pixel storage node through the pixel write circuit.

According to one aspect of the invention, the circuit includes an internal inversion circuit operatively coupled to the hold circuit and the pixel storage node and configured to invert the pixel voltage stored on the pixel storage node and presented to the pixel display element.

According to one aspect of the invention, the circuit includes the pixel display element, wherein the pixel display element includes a first electrode and a second electrode, the first electrode electrically connected to the pixel storage node, and the second electrode electrically connected to a third voltage signal line.

According to one aspect of the invention, the pixel write circuit comprises an input node, an output node, and an intermediate node electrically connected between the input node and the output node, wherein the output node is electrically connected to the pixel storage node, wherein the hold circuit comprises a switching device configured to selectively couple the intermediate node to a fourth voltage signal line, and wherein when the pixel circuit is operating in memory mode, the switching device is configured to maintain a voltage on the intermediate node at the same level as a voltage on the pixel storage node.

According to one aspect of the invention, the pixel write circuit comprises a first input transistor and a second input transistor each having a respective drain and source, and the hold circuit further comprises the first input transistor, wherein the drain of the first input transistor and the source of the second input transistor are electrically connected to each other to form the intermediate node, and wherein the drain of the second input transistor comprises the output node.

According to one aspect of the invention, the switching device comprises a supply transistor having a source and drain, the drain of the supply transistor electrically connected to the fourth voltage signal line, and the source of the supply transistor electrically connected to the intermediate node.

According to one aspect of the invention, the first input transistor and the supply transistor pass substantially the same current.

According to one aspect of the invention, the internal inversion circuit comprises: the supply transistor; a cell storage node for storing data stored on the pixel storage node; an inversion transistor having a source and drain, wherein the source of the inversion transistor is electrically connected to the pixel storage node, and the drain of the inversion transistor is electrically connected to the source of the supply transistor; and a pre-charge transistor including a source and drain, wherein the source of the pre-charge transistor is electrically connected to the pixel storage node, and a drain of the pre-charge transistor is electrically connected to the cell storage node to enable selective coupling of the cell storage node to the pixel storage node.

According to one aspect of the invention, the internal inversion circuit further comprises the second storage capacitor, the first electrode of the second storage capacitor electrically connected to the drain of the pre-charge transistor.

According to one aspect of the invention, the first and second input transistors comprise respective gates electrically connected to a row select electrode, and the source of the first input transistor is electrically connected to a column write electrode.

According to one aspect of the invention, the plurality of pixel circuits arranged in a row and column format.

According to one aspect of the invention, a display device comprising: the display circuit described herein, and a display device having a plurality of pixels, each pixel operatively coupled to a respective one of the plurality of pixel circuits.

According to one aspect of the invention, a method of driving a pixel circuit, the pixel circuit comprising a pixel storage node for storing a pixel voltage provided to a pixel display element and including a first storage capacitor comprising a first electrode electrically connected to the pixel storage node and a second electrode electrically connected to a first voltage signal line; a cell storage node for storing the data on the pixel storage node and including a second storage capacitor comprising a first electrode electrically connected to the cell storage node and a second electrode electrically connected to a second voltage signal line different from the first voltage signal line, the method comprising independently driving a voltage provided by the first voltage signal line and a voltage provided by the second voltage signal line to a high state or a low state during a data write cycle of the pixel circuit to increase or decrease the pixel voltage.

According to one aspect of the invention, independently driving comprises transitioning the voltage applied to one of the first or second storage capacitors before an inversion operation in which the pixel voltage stored on the pixel storage node is inverted, and transitioning the voltage provide to the other of the first or second storage capacitors after the inversion operation.

According to one aspect of the invention, independently driving includes independently driving when at least one of data is rewritten to the pixel circuit or when an inversion is performed inside the pixel circuit.

According to one aspect of the invention, independently driving comprises transitioning a voltage applied to one of the first or second storage capacitors to return the pixel storage node to a voltage held when a data write was last performed to the pixel storage node.

According to one aspect of the invention, transitioning comprises using the same levels of transition.

According to one aspect of the invention, the pixel circuit further includes a pixel write circuit configured to write data to the pixel storage node, the pixel write circuit including a column write electrode for receiving data and a row select electrode for writing the data on the column write electrode to the pixel storage node, the method comprising placing the pixel circuit in video mode, said placing in video mode comprising: switching a voltage applied to the row select electrode from a first state to a second state to write data from the column write electrode to the pixel storage node; prior to or during switching the voltage applied to the row select electrode from the first state to the second state, switching a voltage applied to the second electrode of the cell storage capacitor to an opposite state; after switching the voltage applied to the row select electrode from the first state to the second state, switching the voltage applied to the row select electrode from the second state to the first state; and after switching the voltage applied to the row select electrode from the second state to the first state, switching a voltage applied to the second electrode of the pixel storage capacitor to an opposite state.

According to one aspect of the invention, the pixel circuit further comprises a hold circuit operatively coupled to the pixel write circuit and configured to minimize charge leakage from the pixel storage node through the pixel write circuit, the hold circuit including a fourth voltage signal line for receiving a voltage, and an internal inversion circuit operatively coupled to the hold circuit and comprising the cell node, a pre-charge electrode and an inversion electrode, a voltage applied to the pre-charge electrode operative to selectively couple the pixel storage node to the cell node, wherein a voltage applied to the inversion electrode is operative to invert a voltage stored on the pixel storage node and a pixel display voltage applied to a display element that receives data stored on the pixel storage node, wherein placing the pixel circuit in video mode further comprises: prior to switching the voltage applied to the row select electrode from the first state to the second state, switching a voltage applied to the pre-charge electrode and the fourth voltage signal line to a first state; and switching a voltage applied to the inversion electrode to a second state different from the first state applied to the pre-charge electrode and fourth voltage signal line.

According to one aspect of the invention, the method includes placing the pixel circuit in inversion mode, said placing in inversion mode comprising: isolating the cell node from the pixel storage node; switching the voltage applied to the second electrode of the cell storage capacitor to an opposite state; charging the pixel storage node to a first state; and selectively discharging the pixel storage node based on the data stored on the cell node such that the voltage on the pixel storage node is the logical compliment of the voltage stored on the cell node, wherein the voltage on the pixel storage node is discharged to a second state when the data stored on the cell storage capacitor corresponds to the first state, and retaining the pre-charge voltage on the pixel storage node when the data stored on the cell storage capacitor corresponds to the second state.

According to one aspect of the invention, isolating the cell node includes switching a voltage applied to the pre-charge electrode to the second state to isolate the cell node from pixel storage node.

According to one aspect of the invention, the method includes placing the pixel circuit in memory mode, said placing in memory mode including: switching a voltage applied to the fourth voltage signal line and the pre-charge electrode to the first state; switching a voltage applied to the inversion electrode to the second state; and maintaining a voltage applied to the second electrode of the pixel storage capacitor and the cell capacitor at a previous state.

According to one aspect of the invention, placing the pixel circuit in memory mode further comprises switching voltages applied to the column write electrode and the row select electrode to the second state.

According to one aspect of the invention, placing the circuit in memory mode further comprises switching the voltages applied to the row select electrode and the invert electrode to the second state, and switching the voltages applied to the fourth voltage signal line and the pre-charge electrode to the first state.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DESCRIPTION OF REFERENCE NUMERALS

Figure 1:
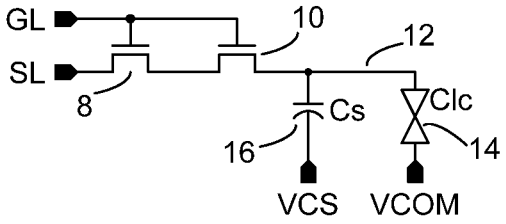
FIG. 1 is a schematic illustration of a pixel circuit from the conventional art.

8 transistor
10 transistor
11 pixel write circuit
11*a* input node
11*b* output node
11*c* intermediate node
12 pixel storage node
14 liquid crystal cell
16 capacitor
22 matrix of picture elements (pixels)
24 data driver
26 scan driver
30 transistor
31 hold circuit
32 transistor
34 cell node capacitor
36 transistor
37 inversion circuit
54 transistor
56 transistor

DETAILED DESCRIPTION OF INVENTION

A pixel circuit in accordance with the invention includes a pixel display element, a pixel storage node for storing and presenting a pixel voltage to a pixel display element, a cell storage node for storing the data on the pixel storage node, and a first storage capacitor and a second storage capacitor each including a first electrode and a second electrode. The first electrode of the first storage capacitor is operatively coupled to the pixel storage node and the first electrode of the second storage capacitor is operatively coupled to the cell storage node. The second electrode of the first and second storage capacitors are operatively coupled to a respective different one of first and second independent voltage signal lines. The circuit further includes a pixel write circuit configured to write the pixel voltage to the pixel storage node during a data write cycle, and to provide respective voltage signals to the first and second independent voltage signal lines, each of the respective voltage signals being changed during the data write cycle in order to increase or reduce the pixel voltage.

In some embodiments, the pixel circuit may include a hold circuit operatively coupled to the pixel write circuit and configured to minimize charge leakage from the pixel storage node through the pixel write circuit, the hold circuit including a power terminal for receiving a voltage. The circuit may also include an internal inversion circuit operatively coupled to the hold circuit and comprising the cell node, a pre-charge terminal and an inversion terminal, the pre-charge terminal operative to selectively couple the pixel storage node to the cell node, wherein the inversion terminal is operative to invert a voltage of the data stored on the pixel storage node and a voltage applied to a display element that receives data stored on the pixel storage node.

In accordance with one aspect of the invention, a method of driving a pixel circuit is provided, the pixel circuit including a pixel storage node for storing a pixel voltage provided to a pixel display element and including a first storage capacitor comprising a first electrode electrically connected to the pixel storage node and a second electrode electrically connected to a first voltage signal line, and a cell storage node for storing the data on the pixel storage node and including a second storage capacitor comprising a first electrode electrically connected to the cell storage node and a second electrode electrically connected to a second voltage signal line different from the first voltage signal line. In accordance with the method, a voltage provided by the first voltage source and a voltage provided by the second voltage source are independently driven to a high state or a low state during a data write cycle of the pixel circuit to increase or decrease the pixel voltage. In addition, the voltage applied to one of the first or second storage capacitors may be transitioned before an inversion operation, and the voltage provide to the other of the first or second storage capacitors may be transitioned after the inversion operation A voltage applied to one of the first or second storage capacitors may be independently transitioned to return the pixel storage node to a voltage held when a data write was last performed to the pixel storage node. In performing the transition, the same levels of transition may be used for each storage capacitor.

In some embodiments, the pixel circuit may include a pixel write circuit configured to write data to the pixel storage node, the pixel write circuit including a column write electrode for receiving data and a row select electrode for writing the data on the column write electrode to the pixel storage node. The pixel circuit may be placed in video mode, which can include switching a voltage applied to the row select electrode from a first state to a second state to write data from the column write electrode to the pixel storage node. Prior to or during switching the voltage applied to the row select electrode from the first state to the second state, a voltage applied to the second electrode of the cell storage node is switched to an opposite state. After switching the voltage applied to the row select electrode from the first state to the second state, the voltage applied to the row select electrode is switched from the second state to the first state. Then after switching the voltage applied to the row select electrode from the second state to the first state, a voltage applied to the second electrode of the pixel storage capacitor is switched to an opposite state.

Figure 2:
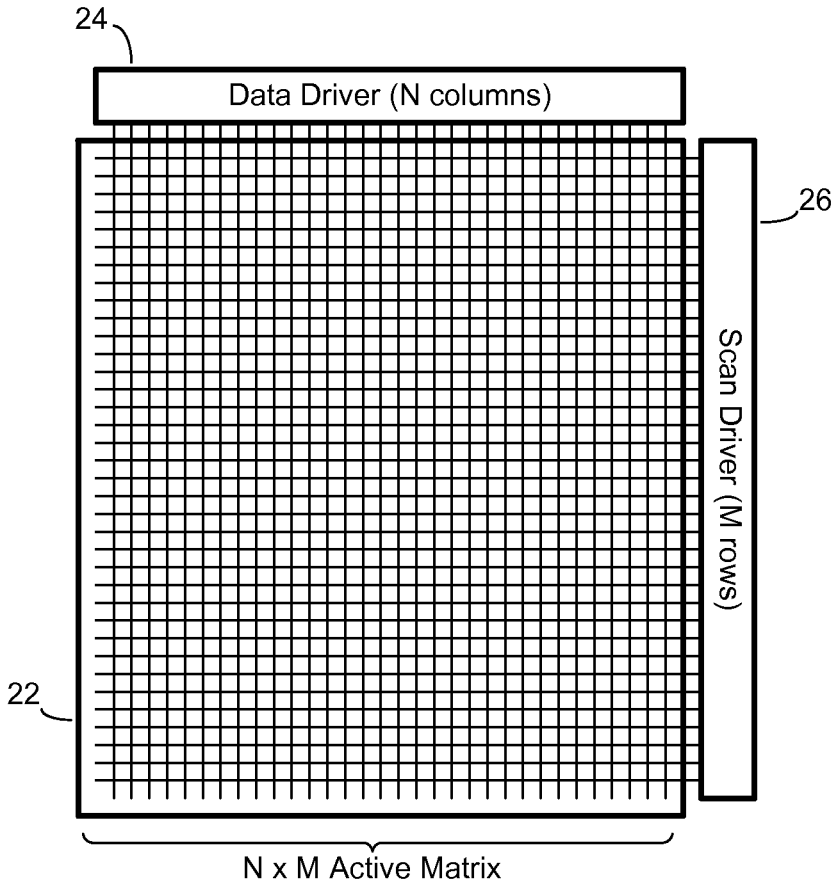
FIG. 2 is a schematic illustration of an active matrix display incorporating an exemplary pixel configuration in accordance with a first embodiment of the invention.

A first embodiment of a display device in accordance with the present invention is shown in FIG. 2. A matrix 22 of picture elements (pixels) is arranged in M rows and N columns. Each pixel row is connected to a respective row electrode and each pixel column is connected to a respective column electrode, with the column electrodes being connected to the N outputs of a data driver 24 and the row electrodes being connected to the M outputs of a scan driver 26.

Figure 3:
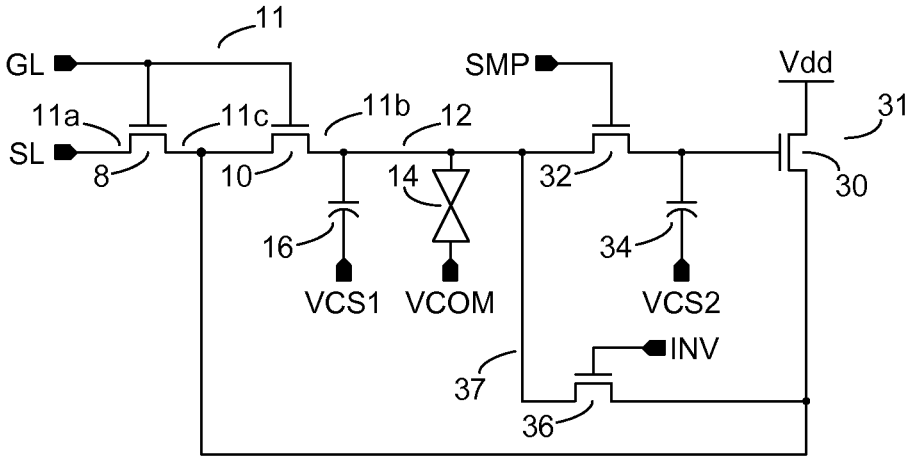
FIG. 3 is a schematic illustration of the pixel configuration illustrated in FIG. 2.

A pixel circuit in accordance with the first embodiment is shown in FIG. 3. The circuit is composed of n-channel transistors 8, 10, 30, 32 and 36, capacitors 16 and 34 and a display element 14, such as a liquid crystal cell. The gates of transistors 8 and 10 (first and second input transistors, respectively) are connected to a GL input (row select electrode); the source of transistor 8 is connected to a SL input (column write electrode); the drain of transistor 8 is connected to the source of transistor 10, the drain of transistor 36 (inversion transistor) and the source of transistor 30 (supply transistor); the drain of transistor 10 is connected to the first electrode of a first storage capacitor 16 (pixel storage capacitor), the first electrode of the liquid crystal cell 14 and the sources of transistors 32 and 36; the gate of transistor 32 is connected to an SMP input (pre-charge electrode); the drain of transistor 32 (pre-charge transistor) is connected to the gate of transistor 30 and to the first electrode of a second storage capacitor 34 (cell storage capacitor); the gate of transistor 36 is connected to an INV input (invert electrode); the second electrode of the liquid crystal cell 14 is connected to a VCOM input (also referred to as a third voltage signal line); the drain of transistor 30 is connected to a Vdd input (also referred to as a fourth voltage signal line); the second electrode of the capacitor 16 is connected to a VCS1 input (also referred to as a first voltage signal line); and the second electrode of the capacitor 34 is connected to a VCS2 input (also referred to as a second voltage signal line).

The VCOM input may be common to all pixels, and may be an electrode on the opposing substrate of the LCD. The VCS1 and VCS2 inputs may be connected to the VCS1 and VCS2 inputs respectively of all the pixels in the same row.

Transistors 8 and 10 form an exemplary pixel write circuit 11 that is configured to receive data and to provide the data the pixel storage node and liquid crystal cell 14. The exemplary pixel write circuit 11 includes an input node 11*a*, and output node 11*b*, and an intermediate node 11*c* arranged electrically between the input node and output node.

Transistors 8 and 30 form an exemplary hold circuit 31 configured to minimize charge leakage from the liquid crystal cell/pixel storage node 12 through the pixel write circuit 11. More particularly, and as discussed below, the transistor 30, which can function as a switching device, along with transistor 8 of the pixel write circuit 11 maintain a voltage on the intermediate node 11*c* at substantially the same level as a voltage on the pixel storage node 12. In this manner, leakage from the pixel storage node 12 through the pixel write circuit 11 is minimized.

Transistors 36, 32 and 30 form an inversion circuit 37 configured to invert a voltage on the liquid crystal cell 14 as well as a voltage of the data stored on the pixel storage node 12. Inversion of the voltage on the pixel storage cell and liquid crystal cell refers to a "logical" inversion (e.g., from a high state to a low state or from a low state to a high state). Operation of the inversion circuit 37 is described in more detail below.

As will be appreciated, a number of transistors in the circuit of FIG. 3 have dual roles, i.e., they are part of different functional circuits. For example, transistor 8 is not only part of the write circuit 11, but also part of the hold circuit 31. Similarly, while transistors 30, 32 and 36 form the core of the inversion circuit 37, all of the transistors in FIG. 3 may take at least some part in the inversion function. However, in other configurations transistors may not have dual roles. The device and method in accordance with the present invention includes embodiments in which transistors are dedicated to a particular function and embodiments in which transistors have multi-roles (e.g., a transistor is used in two or more different functional portions of the circuit). The pixel has three modes of operation: video mode, where data is written from the driver at full frame rate (typically 60 Hz); memory mode, where the pixel maintains its data; and inversion mode, where the pixel inverts the stored data.

Figure 4:
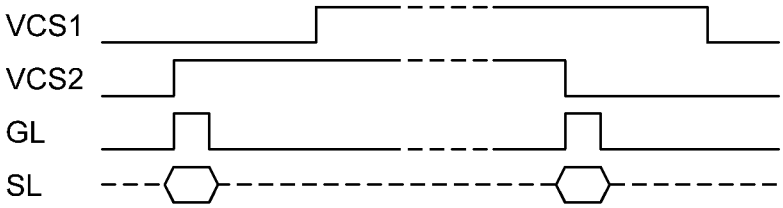
FIG. 4 is a timing diagram illustrating a method of operating the pixel of FIG. 3 during video mode.

The method of driving for video mode is shown in FIG. 4. Voltages applied to Vdd and SMP are switched (held) high, a voltage applied to INV is switched (held) low, and voltages applied to the GL and SL signals operate as for a conventional active matrix display, such that while GL is switched high, image data is presented on the SL input, and is sampled onto the pixel storage node 12. The voltage applied to the VCOM input is held at a direct current (dc) level. The timing of VCS1 and VCS2 may be designed to match that in inversion mode. In this way, the level of boost applied by the common capacitor drive is the same in both modes, and the same voltage levels can be used for image data and the VCS lines. This simplifies the system design.

For a positive frame, the voltage applied to VCS2 switches from low to high before or during the GL pulse, while the voltage applied to VCS1 is switched from low to high after the falling edge on GL. The timing of the VCS2 transition is chosen such that the voltage on the pixel storage node 12 immediately before the falling edge of GL is substantially equal to the image data voltage held at the SL input. The transition of VCS1 raises the voltage on the pixel storage node, 12, as described in the background art. The timing for a negative frame is the same, with low and high states interchanged.

In memory mode, the voltages applied to Vdd and SMP are switched (held) high, the voltage applied to INV is switched (held) low, the voltages applied to VCS1 and VCS2 retain their previous state, and the voltages applied to SL and GL inputs are held at substantially the same low level. The VCOM input is held at a dc level. Transistors 8 and 30 act to maintain the voltage on the drain of transistor 8 and the source of transistor 10 at a similar level to the voltage on the pixel storage node 12. Typically, a "similar level" is of the order of 100 mV, although this depends on the transistor performance, the voltage range, etc. Transistor 10 therefore has a very low drain-source voltage, and leakage current from the pixel is minimized.

The only direct current path in the pixel is from Vdd to the SL input, via the conduction paths of transistors 8 and 30. Transistors 8 and 30 therefore pass substantially the same current. In this context, there are 3 paths leading into node 11*c*: through transistors 30, 8 and 10. The current through transistor 10 is the leakage from the pixel, which we are seeking to minimise. Typically this is about 100 times smaller than the current through transistor 30, although again, this depends on the performance of the circuit. If the transistors are sized substantially identically, they will maintain substantially the same bias conditions to pass this current. The bias conditions depend on the pixel voltage (data). In some cases, the transistors have the same bias conditions, in others their gate-source voltage will vary by O(100 mV) while their drain-source voltages will be different by several volts. If the GL and SL inputs are held at substantially the same low voltage (ideally, they are at the same voltage—the only variation will occur because the GL and SL inputs are controlled by different circuits, so they may be at slightly different voltages instant by instant due to noise, etc.), the gate-source voltage of transistor 8 is substantially zero (ideally exactly zero, but in reality it will always be about zero, due to noise (as in the explanation just above)); if the voltage on the pixel storage node 12 is exactly mid-way between the Vdd voltage and the voltage applied to the GL and SL inputs, both transistors 8 and 30 will have the same bias conditions (the same drain-source and gate-source voltages) if the source of transistor 30 is also exactly mid-way between the Vdd voltage and the voltage applied to the GL and SL inputs. In this case, the drain-source voltage of transistor 10 is zero, and no leakage current can flow from the pixel storage node 12.

In the case where the voltage on the pixel storage node 12 is greater than mid-way between the Vdd voltage and the voltage applied to the GL and SL inputs, transistors 8 and 30 will draw the same current if the source of transistor 30 is at a slightly lower voltage than the pixel storage node 12. In this case, the gate-source voltage of transistor 8 is substantially zero, while its drain-source voltage is more than half the difference between the Vdd voltage and the voltage applied to the GL and SL, and the transistor draws slightly more current than in the mid-voltage case. Transistor 30 preferably draws substantially the same current as transistor 8, but it has a lower drain-source voltage than transistor 8. This difference is compensated for by the slightly higher gate-source voltage of transistor 30. This is part of the explanation of the operation, rather than a definition of how to operate the circuit. The bias conditions for transistor 8 are fixed by the levels applied to the GL and SL inputs, and by the pixel voltage. Transistor 30 must (by Kirchoff's laws) supply the majority of this current (the rest is pixel leakage through transistor 10—about 100 times smaller), so its bias condition is forced. As it works out, this large difference in drain-source voltage can be compensated for by a small difference in gate-source voltage, so node 11*c* is held very close to the pixel voltage.

Conversely, in the case where the voltage on the pixel storage node 12 is lower than mid-way between the Vdd voltage and the voltage applied to the GL and SL inputs, transistors 8 and 30 will draw the same current if the source of transistor 30 is at a slightly higher voltage than the pixel storage node 12. As before, the gate-source voltage of transistor 8 is substantially zero, but its drain-source voltage is less than half the difference between the Vdd voltage and the voltage applied to the GL and SL, and the transistor draws slightly less current than in the mid-voltage case. Transistor 30 preferably draws substantially the same current as transistor 8, but it has a higher drain-source voltage than transistor 8. This difference is compensated for by the slightly lower (i.e. negative) gate-source voltage of transistor 30.

Since the current through a transistor is more strongly dependant on its gate-source voltage than its drain-source voltage, a large disparity between the drain-source voltages of transistors 8 and 30 can be compensated for by a small disparity in their gate-source voltages. Typically, a volt of drain-source voltage disparity may be compensated for by tens of millivolts of gate-source voltage disparity. The source voltage of transistor 30 therefore remains very close to the voltage on the pixel storage node 12 and leakage current through transistor 10 is minimised across a range of pixel voltages. The display may be operated with alternating current or direct current VCOM drive.

Figure 5:
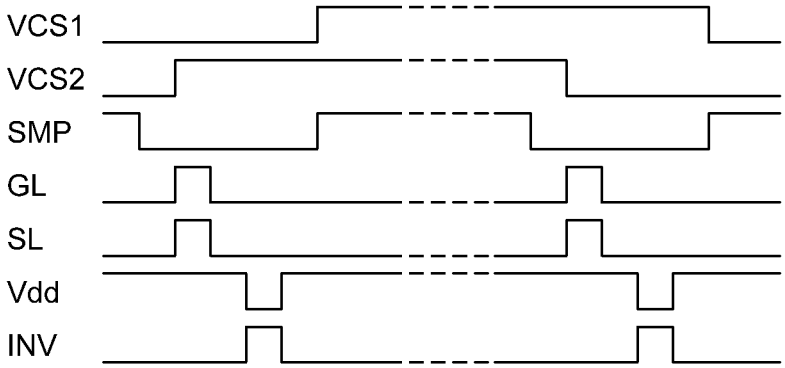
FIG. 5 is a timing diagram illustrating a method of operating the pixel FIG. 3 during inversion mode.

The timing of the inversion operation is shown in FIG. 5, and happens in three phases. First, the current pixel voltage is isolated onto a capacitor, and the opposite plate of the capacitor is switched to the opposite level; second, a node of the pixel is precharged to a high level; finally the precharged node is selectively discharged, depending on the value of the stored data, either being discharged to a low level or being allowed to retain its precharge voltage.

To implement the isolation phase, a voltage applied to the SMP is lowered, switching off transistor 32 and isolating the voltage on the first electrode of capacitor 34. This voltage may represent the final voltage on the pixel storage node, after the data was sampled from the SL input and the subsequent transition on the VCS1 pin. Alternatively, it may represent the final voltage on the pixel storage node at the end of an inversion operation, which includes a final transition on the VCS1 pin. In both cases, the voltage is either higher or lower than the voltage originally written, that is, the voltage on the pixel storage node 12 before the final transition on the VCS1 input. The voltage is returned to substantially its original level by a transition on the VCS2 pin. The exact level of the final voltage may be optimised by choosing the correct size capacitor 34 and/or the voltage swing on VCS2 during the transition.

To implement the precharge phase, the voltage applied to GL is switched to a high level, turning on transistors 8 and 10, and the voltage applied to SL is switched to a high level. The voltage applied to GL is raised to a higher level than the voltage applied to SL such that transistors 8 and 10 fully conduct the voltage on SL, charging the first electrodes of the first capacitor 16 and LC cell 14 to the voltage on the SL line. The voltage applied to GL is then switched to its previous low level, turning off transistors 8 and 10 and isolating the precharged node.

In the selective discharge phase, the voltage applied to INV is switched to a high level, turning on transistor 36, and the voltage applied to Vdd is switched to a low level. If the data stored on the first electrode of capacitor 34 is high, transistor 30 is switched on, and the first electrodes of the first capacitor 16 and LC cell 14 are discharged to the low level on Vdd via transistors 36 and 30. If the data stored on the first electrode of capacitor 34 is low, transistor 30 remains off, and the first electrodes of the first capacitor 16 and LC cell 14 retain the precharge voltage. In each case, the final voltage on the first electrodes of the first capacitor 16 and LC cell 14 is the logical complement of the data voltage stored on the first electrode of capacitor 34, and the data applied to the LC has been inverted.

The final stage of the operation is for the pixel to return to memory mode: after a predetermined time period, the voltages applied to SMP and Vdd are switched to their original high levels, and the voltage applied to INV is switched to its original low level. The charge stored on both capacitors and the LC cell is shared, giving a final voltage that is either slightly higher than the low level of Vdd, or slightly lower than the precharge voltage. The second capacitor 54 may be sized significantly smaller than the sum of the larger capacitor 16 and the LC capacitance 14 to minimise this change in voltage. The voltage applied to the VCS1 input then makes its transition, raising or lowering the voltage on the pixel storage node as in video mode. The values of Vdd and the precharge voltage, and the voltage swing on VCS1 may be optimised such that the final pixel voltages are equal to the black and white voltages of the LC. Alternatively, the values of Vdd and the precharge voltage may be optimised such that the final pixel voltages correspond to a wider range of voltages, such that the higher pixel voltage is greater than the higher of the black and white LC voltages, and/or the lower pixel voltage is less than the lower of the black and white LC voltages.

In another embodiment, the timing and voltages applied to the VCS inputs may differ in video and inversion modes: in video mode, both VCS inputs may transition in unison, such that the pixel behaves as a known common capacitor drive pixel; in inversion mode, the VCS inputs may switch independently, as previously described. In this case, it may be desirable to adjust the voltage swing applied to the VCS inputs in the different modes.

In another embodiment, the swing on VCS2 may be different from that on VCS1. For example, if the voltage on the pixel storage node tends towards the centre of the range of voltages applied to the Vdd and SL inputs during memory mode, it may be desirable to reduce the level of swing applied to VCS2 so that the combination of voltage degradation during memory mode and capacitive coupling during the VCS2 transition returns the voltage on the top plate of capacitor 34 to its initial level.

Many variations on the above circuits will be apparent to one skilled in the art. Examples include: some or all of the transistors 10, 50 and 52 may be changed for double-gate transistors to reduce leakage (higher numbers of gates are also possible, but may have a detrimental effect on the time taken for data writing and/or inversion); the leakage reduction circuit transistors 8 and 30 may be changed for double-gate transistors (again, higher numbers of gates are possible, but may have a detrimental effect on operation); the n-channel transistors described may be replaced by p-channel transistors, and all signals inverted; the LC cell may be replaced by another voltage-driven optical layer such as organic light-emitting diode (OLED) or an electrophoretic or electrowetting element.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

INDUSTRIAL APPLICABILITY

The present invention may be utilised to provide a low-power, high resolution display for use in portable and battery-powered devices. Such a display has the benefits of increasing the time the device may operate on one charge of its battery while still being able to show high-quality images.

What is claimed is:

1. A pixel circuit of a pixel for a display, comprising:

a pixel storage node for storing and presenting a pixel voltage to a pixel display element;

a cell storage node for storing a data on the pixel storage node;

a first storage capacitor and a second storage capacitor each including a first electrode and a second electrode, the first electrode of the first storage capacitor operatively coupled directly to the pixel storage node without any transistor provided between the first electrode of the first storage capacitor and the pixel storage node, the first electrode of the second storage capacitor operatively coupled to the cell storage node, and the second electrode of the first and second storage capacitors operatively coupled to a respective different one of first and second independent voltage signal lines; and a pixel write circuit configured to write the pixel voltage to the pixel storage node during a data write cycle, and to provide respective voltage signals to the first and second independent voltage signal lines, each of the respective voltage signals being changed during the data write cycle in order to increase or reduce the pixel voltage, wherein the pixel circuit both minimizes a leakage of charge from the pixel and inverts the pixel voltage within the pixel, the leakage of charge from the pixel is minimized without an addition of an amplifier to a standard display circuit;

the pixel circuit does not comprise a static random access memory;

a hold circuit operatively coupled to the pixel write circuit and configured to minimize leakage of charge from the pixel storage node through the pixel write circuit; and an internal inversion circuit operatively coupled to the hold circuit and the pixel storage node and configured to invert the pixel voltage stored on the pixel storage node and presented to the pixel display element.

2. The pixel circuit according to claim 1, further comprising the pixel display element, wherein the pixel display element includes a first electrode and a second electrode, the first electrode electrically connected to the pixel storage node, and the second electrode electrically connected to a third voltage signal line.

3. The pixel circuit according to claim 1, wherein the pixel write circuit comprises an input node, an output node, and an intermediate node electrically connected between the input node and the output node, wherein the output node is electrically connected to the pixel storage node, wherein the hold circuit comprises a switching device configured to selectively couple the intermediate node to a fourth voltage signal line, and wherein when the pixel circuit is operating in memory mode, the switching device is configured to maintain a voltage on the intermediate node at the same level as a voltage on the pixel storage node.

4. The pixel circuit according to claim 3, wherein the pixel write circuit comprises a first input transistor and a second input transistor each having a respective drain and source, and the hold circuit further comprises the first input transistor, wherein the drain of the first input transistor and the source of the second input transistor are electrically connected to each other to form the intermediate node, and wherein the drain of the second input transistor comprises the output node.

5. The pixel circuit according to claim 4, wherein the switching device comprises a supply transistor having a source and drain, the drain of the supply transistor electrically connected to the fourth voltage signal line, and the source of the supply transistor electrically connected to the intermediate node.

6. The pixel circuit according to claim 5, wherein the first input transistor and the supply transistor pass substantially the same current.

7. The pixel circuit according to claim 5, wherein the internal inversion circuit comprises:

the supply transistor;

the cell storage node for storing data stored on the pixel storage node;

an inversion transistor having a source and drain, wherein the source of the inversion transistor is electrically connected to the pixel storage node, and the drain of the inversion transistor is electrically connected to the source of the supply transistor; and a pre-charge transistor including a source and drain, wherein the source of the pre-charge transistor is electrically connected to the pixel storage node, and a drain of the pre-charge transistor is electrically connected to the cell storage node to enable selective coupling of the cell storage node to the pixel storage node.

8. The pixel circuit according to claim 7, wherein the internal inversion circuit further comprises the second storage capacitor, the first electrode of the second storage capacitor electrically connected to the drain of the pre-charge transistor.

9. The pixel circuit according to claim 7, wherein the first and second input transistors comprise respective gates electrically connected to a row select electrode, and the source of the first input transistor is electrically connected to a column write electrode.

10. A display circuit comprising a plurality of pixel circuits according to claim 1, the plurality of pixel circuits arranged in a row and column format.

11. A display, comprising:

the display circuit according to claim 10; and a display device having a plurality of pixels, each pixel operatively coupled to a respective one of the plurality of pixel circuits.

12. A method of driving a pixel circuit of a pixel, the pixel circuit comprising a pixel storage node for storing a pixel voltage provided to a pixel display element and including a first storage capacitor comprising a first electrode electrically connected directly to the pixel storage node without any transistor provided between the first electrode of the first storage capacitor and the pixel storage node, and a second electrode electrically connected to a first voltage signal line, a cell storage node for storing a data on the pixel storage node and including a second storage capacitor comprising a first electrode electrically connected to the cell storage node and a second electrode electrically connected to a second voltage signal line different from the first voltage signal line, a hold circuit operatively coupled to the pixel write circuit and configured to minimize leakage of charge from the pixel storage node through the pixel write circuit, and an internal inversion circuit operatively coupled to the hold circuit and the pixel storage node and configured to invert the pixel voltage stored on the pixel storage node and presented to the pixel display element, the method comprising:

independently driving a voltage provided by the first voltage signal line and a voltage provided by the second voltage signal line to a high state or a low state during a data write cycle of the pixel circuit to increase or decrease the pixel voltage; and minimizing a leakage of charge from the pixel and inverting the pixel voltage within the pixel, wherein the leakage of charge from the pixel is minimized without an addition of an amplifier to a standard display circuit, and the pixel circuit does not comprise a static random access memory.

13. The method according to claim 12, wherein independently driving comprises transitioning the voltage applied to one of the first or second storage capacitors before an inversion operation in which the pixel voltage stored on the pixel storage node is inverted, and transitioning the voltage provide to the other of the first or second storage capacitors after the inversion operation.

14. The method according to claim 13, wherein independently driving includes independently driving when at least one of data is rewritten to the pixel circuit or an inversion is performed inside the pixel circuit.

15. The method according to claim 13, wherein transitioning comprises using the same levels of transition.

16. The method according to claim 12, wherein independently driving comprises transitioning a voltage applied to one of the first or second storage capacitors to return the pixel storage node to a voltage held when a data write was last performed to the pixel storage node.

17. The method according to claim 12, wherein the pixel circuit further includes a pixel write circuit configured to write data to the pixel storage node, the pixel write circuit including a column write electrode for receiving data and a row select electrode for writing the data on the column write electrode to the pixel storage node, the method comprising placing the pixel circuit in video mode, said placing in video mode comprising:

switching a voltage applied to the row select electrode from a first state to a second state to write data from the column write electrode to the pixel storage node;

prior to or during switching the voltage applied to the row select electrode from the first state to the second state, switching a voltage applied to the second electrode of the second storage capacitor to an opposite state;

after switching the voltage applied to the row select electrode from the first state to the second state, switching the voltage applied to the row select electrode from the second state to the first state; and after switching the voltage applied to the row select electrode from the second state to the first state, switching a voltage applied to the second electrode of the first storage capacitor to an opposite state.

18. The method according to claim 17, wherein the hold circuit includes a fourth voltage signal line for receiving a voltage, and the internal inversion circuit comprises the cell storage node, a pre-charge electrode and an inversion electrode, a voltage applied to the pre-charge electrode operative to selectively couple the pixel storage node to the cell storage node, wherein a voltage applied to the inversion electrode is operative to invert a voltage stored on the pixel storage node and a pixel display voltage applied to a display element that receives data stored on the pixel storage node, wherein placing the pixel circuit in video mode further comprises:

prior to switching the voltage applied to the row select electrode from the first state to the second state, switching a voltage applied to the pre-charge electrode and the fourth voltage signal line to a first state; and switching a voltage applied to the inversion electrode to a second state different from the first state applied to the pre-charge electrode and fourth voltage signal line.

19. The method according to claim 18, further comprising placing the pixel circuit in memory mode, said placing in memory mode including:

switching a voltage applied to the fourth voltage signal line and the pre-charge electrode to the first state;

switching a voltage applied to the inversion electrode to the second state; and maintaining a voltage applied to the second electrode of the first storage capacitor and the second storage capacitor at a previous state.

20. The method according to claim 19, wherein placing the pixel circuit in the memory mode further comprises switching voltages applied to the column write electrode and the row select electrode to the second state.

21. The method according to claim 19, wherein placing the pixel circuit in the memory mode further comprises switching the voltages applied to the row select electrode and the inversion electrode to the second state, and switching the voltages applied to the fourth voltage signal line and the pre-charge electrode to the first state.

22. The method according to claim 12, further comprising placing the pixel circuit in inversion mode, said placing in inversion mode comprising:

isolating the cell storage node from the pixel storage node;

switching the voltage applied to the second electrode of the second storage capacitor to an opposite state;

charging the pixel storage node to a first state; and selectively discharging the pixel storage node based on the data stored on the cell storage node such that the voltage on the pixel storage node is the logical compliment of the voltage stored on the cell storage node, wherein the voltage on the pixel storage node is discharged to a second state when the data stored on the second storage capacitor corresponds to the first state, and retaining the pre-charge voltage on the pixel storage node when the data stored on the second storage capacitor corresponds to the second state.

23. The method according to claim 22, wherein isolating the cell storage node includes switching a voltage applied to the pre-charge electrode to the second state to isolate the cell storage node from pixel storage node.

* * * * *